US005861568A

United States Patent [19]

Abreu et al.

[11] Patent Number: 5,861,568

[45] Date of Patent: Jan. 19, 1999

[54] GENERATION OF WAVE FUNCTIONS BY STORAGE OF PARAMETERS FOR PIECEWISE LINEAR APPROXIMATIONS

[75] Inventors: Eduardo Abreu, Allentown; Jalil Fadavi-Ardekani, Orefiled, both of Pa.

[73] Assignee: Lucent Technologies Inc., Murray Hill, N.J.

[21] Appl. No.: 50,153

[22] Filed: Mar. 30, 1998

[51] Int. Cl.[6] ..... G10H 1/04; G10H 7/00

[52] U.S. Cl. ..... 84/624; 84/626

[58] Field of Search ..... 84/624, 626, 627, 84/663

[56] References Cited

U.S. PATENT DOCUMENTS

| | | | |
|---|---|---|---|
| 4,018,121 | 4/1977 | Chowning . | |
| 4,249,447 | 2/1981 | Tomisawa | 84/624 X |
| 4,643,066 | 2/1987 | Oya | 84/624 |
| 4,813,326 | 3/1989 | Hirano et al. | 84/624 |
| 5,218,156 | 6/1993 | Iizuka et al. | 84/624 |
| 5,548,080 | 8/1996 | Minamitaka et al. | 84/627 |
| 5,581,045 | 12/1996 | Peers, Jr. | 84/647 |
| 5,610,354 | 3/1997 | Masahiro et al. | 84/624 |

OTHER PUBLICATIONS

Yamaha LSI, *YMF289 Application Manual OPL3 Low Voltage Version,* Feb. 16, 1995.

*Primary Examiner*—William M. Shoop, Jr.
*Assistant Examiner*—Jeffrey W. Donels

[57] ABSTRACT

An improved method for generating various wave functions for use in musical tone generation in FM synthesis so as to substantially reduce computational and storage requirements. The waveform desired to be used is mathematically modeled using piecewise linear approximation. A reduced number of coefficients of the piecewise linear approximation, representing the angles and offsets of the linear segments, are stored in memory.

24 Claims, 3 Drawing Sheets

GENERATION OF WAVE FUNCTIONS BY STORAGE OF PARAMETERS FOR PIECEWISE LINEAR APPROXIMATIONS

FIELD OF THE INVENTION

This invention relates to waveform generation as typically used in FM synthesis.

BACKGROUND OF THE INVENTION

Musical synthesizers have become very popular among both professional and amateur musicians. Typically, a synthesizer can provide the sound of a variety of musical instruments. Some synthesizers can also generate the sound of a variety of instruments at a same time, such that one player may emulate an entire orchestra. Some of these synthesizers operate based on the principles of frequency modulation, FM, synthesis.

It is well known that the frequency spectrum of an FM modulated signal contains a sizeable number of harmonics. By manipulating the pertinent parameters in an FM modulation scheme, it is possible to provide signals that emulate the sound of musical instruments. Such manipulation of parameters in an FM modulation scheme is referred to as FM synthesis. FM synthesis exploits the fact that modulating one waveform with another waveform produce a waveform with many more harmonics than were present in either of the waveforms. For example, in a typical FM based synthesizer, the phase of a carrier sine signal is in turn another modulating sine signal. The frequency ratio of modulator to carrier will determine which harmonics will result. The amplitude of modulating signal determines how many of the potential harmonics will result.

There are various implementations of FM synthesis to emulate musical tones such as the systems disclosed in U.S. Pat. Nos. 4,018,121, 4,249,447, 4,643,066, and 4,813,326, the disclosures of which are hereby incorporated by reference. All of the systems disclosed in these patents utilize a waveform in performing FM synthesis. In U.S. Pat. No. 4,018,121, for example, the waveform is generated from a sine table. (See Col. 19, lines 32–41) Similarly, a sine memory is used to generate the waveform in U.S. Pat. No. 4,249,447. (See Col. 8, lines 40–45; Col, 9, lines 56–68) A sine wave waveform memory is used to obtain a sine wave in U.S. Pat. No. 4,643,066. (See Col. 11, lines 22–33) A waveshape table is used to generate the waveshape in U.S. Pat. No. 4,813,326. (See Col. 1, lines 60–66)

As these patents demonstrate, the wave functions needed to perform FM synthesis are usually generated using lookup table methods. Typically, when a lookup table is used a function is evaluated by reading its values directly from a memory containing a large number of samples of the function. Alternatively, Taylor series methods may be used to evaluate the desired function. Taylor series methods are less suitable, however, due to the large amount of computation required.

Thus, there is a need for a more efficient generation of wave functions, particularly those wave functions used in FM synthesis.

SUMMARY OF THE INVENTION

Briefly, in accordance with one embodiment of the present invention, a method for generating various wave functions is disclosed which may reduce storage requirements. The waveform desired to be used is mathematically modeled using piecewise linear approximation. The coefficients of the piecewise linear approximation, representing the angles and offsets of the linear segments, are stored in memory, instead of storing the samples of the desired waveform in a waveform sample table.

BRIEF DESCRIPTION OF THE DRAWINGS

The subject matter regarded as the invention is particularly pointed out and distinctly claimed in the concluding portion of the specification. The invention, however, both as to organization and method of operation, together with features, objects, and advantages thereof may best be understood by reference to the following detailed description when read with the accompanying drawings in which:

DETAILED DESCRIPTION OF THE DRAWINGS

The principal of generation of musical tones by the FM system according to the present invention will now be described.

A frequency modulated signal FM(t) is generally expressed by $$FM(t)=A \sin(\omega_c t+B \sin \omega_m t) \quad (1)$$

where $\omega_c$ represents the angular frequency of a carrier wave, $\omega_m$ the angular frequency of a modulating wave, B the modulation index or modulation envelope of the modulating wave, A the envelope of the carrier wave, and t time.

Equation 1 can be rewritten by applying a Fourier transform in spectrum elements with such frequencies as $\omega_c+\omega_m$, $\omega_c-\omega_m$, $\omega_c+2\omega_m$, $\omega_c-2\omega_m$, $\omega_c+3\omega_m$, $\omega_c-3\omega_m$, $\omega_c+4\omega_m$, $\omega_c-4\omega_m$ to be mixed in addition to the original frequencies of the carrier. These elements are called higher harmonics. The frequency of the harmonics is determined by the frequency of the carrier and ratio of the frequency of the modulator to the carrier. The amount of the higher harmonics is determined by the 'B' amplitude of the modulator.

Equation 1 represents a basic frequency modulation signal without feedback. It is also possible to introduce feedback into the modulation. When feedback is present, the frequency modulation signal may be expressed by $$FM(t)=A \sin\{\omega t+\beta FM(t)\} \quad (2)$$

wherein 'β' represents the feedback ratio. It is noted that a frequency modulation scheme with feedback as illustrated in equation 3 is a simple way to generate a spectra rich in harmonics. In many synthesizer systems a module that generates a sine signal employed by equations (1) or (2) is referred to as an operator. In such systems a plurality of operators are coupled together in a variety of configurations to produce a desired tone. For example, one feedback operator can produce a sawtooth-like spectra (which is useful when trying to make string sounds). Furthermore, inharmonic noise can be generated when a feedback operator has a non-integral frequency ratio to another operator.

It should be noted that in accordance with one embodiment of the invention Equations (1) and (2) employ sinusoidal waveforms as will be explained in more detail, however, the invention is not limited in scope in that aspect. For example, other wave functions may also be used. Typically, sinusoids are used in the synthesis of musical instrument sounds, while other type of functions may be used for special effects applications, such as in games, toys, etc.

Figure 1A:
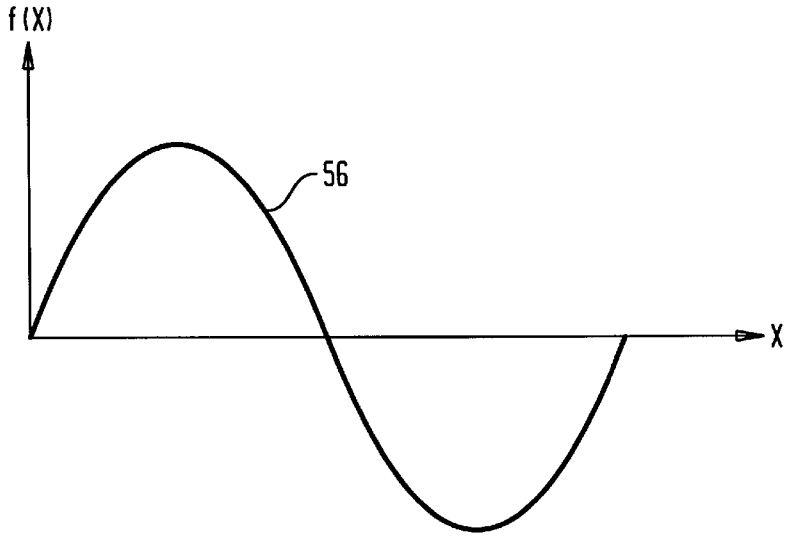
FIG. 1*a* shows a wave function f(x) desired to be used in FM synthesis in accordance with one embodiment of the present invention.
Figure 1B:
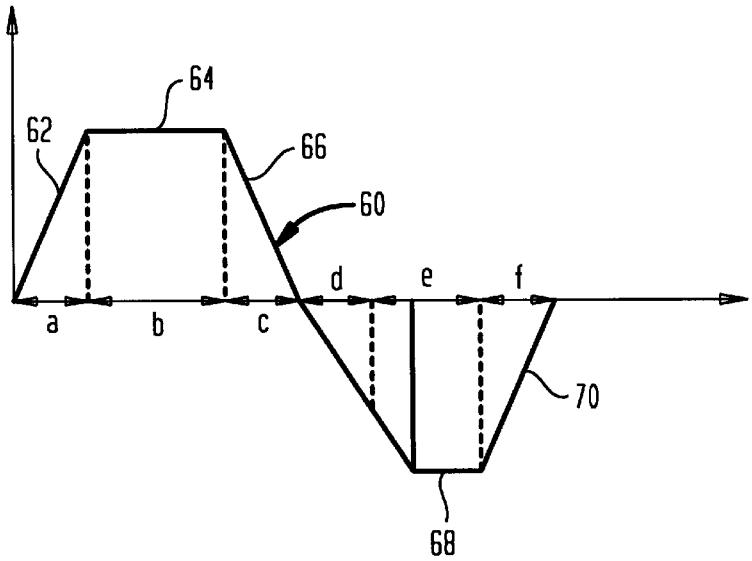
FIG. 1*b* shows function g(x), which is a piecewise linear approximation of f(x) desired to be used in FM synthesis in accordance with the present invention.

FIG. 1*a* depicts a plot 56 which represents a wave function f(x) desired to be used in FM synthesis in accordance with one embodiment of the present invention. As shown, this function is a pure sinusoid, although as previously mentioned, the wave function need not be a sinusoid. FIG. 1*b* is a plot 60, which represents a wave function g(x), which is a piecewise linear approximation of function f(x) of FIG. 1*a*. These two function are approximately equal, and may be represented by the following equation:

$$f(x) \approx g(x) = C_1 + D_1, \text{ first segment}(a) \quad (3)$$

$$C_2x + D_2, \text{ second segment}(b)$$

$$C_3x + D_3, \text{ third segment}(c)$$

etc.

wherein the first segment is defined by a line 62, the second segment is defined by a line 64, the third segment is defined by a line 66 and so forth. Thus, by using equation (3), any value $g(x_i)$ is computed with one single multiplication and addition. It is noted that for a tone signal, $x_i$ corresponds to units of time and $g(x_i)$ corresponds to a linear approximated value for waveform g(x) when variable $x=x_i$. For example, a linear approximated value of $g(x_i)=Cx_i+D$. In accordance with the present invention, the coefficients C and D are stored in a memory, as will be described in more detail in reference with FIG. 3, and correspond to the segment that sample $x_i$ is located in. These coefficients represent the angles and offsets of the linear segments. Therefore, instead of storing a large number of samples of f(x), a much reduced number of coefficients of $C_i$ and $D_i$ are stored in accordance with the present invention.

Figure 2:
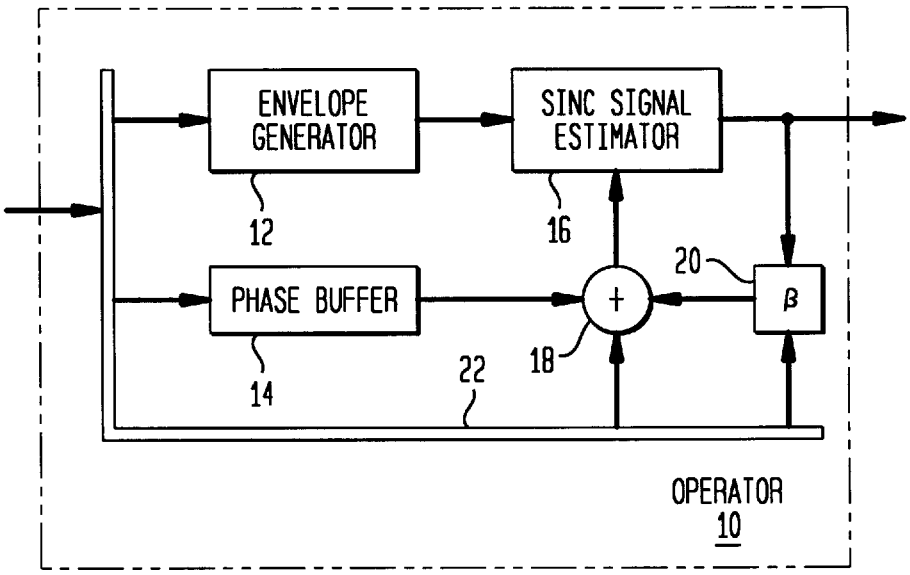
FIG. 2 is a block diagram of an operator circuit that generates a frequency modulated signal in accordance with one embodiment of the present invention.

FIG. 2 illustrates an operator circuit 10 in accordance with one embodiment of the present invention, although the invention is not limited in scope in that respect and other types of operator circuits may be employed. Operator circuit 10 is capable to generate a frequency modulated signal such as the one represented in equations (1) or (2). The operator circuit includes an envelope generator 12, which is configured to receive data from a bus 22. It also includes a phase buffer 14, which is also configured to receive data from bus 22. In one embodiment of the invention, the phase information, stored in phase buffer 14, is calculated by an external processor.

An output port of envelope generator 12 is coupled to an input port of a sine signal estimator 16. An output port of phase buffer 14 is coupled to an input port of an adder 18. Another input port of adder 18 is configured to receive signals from bus 22. A third input port of adder 18 is configured to receive a signal that represents a feedback parameter β. The output port of adder 18 is coupled to another input port of sine signal estimator 16. In accordance with one embodiment of the invention appropriate control and data signals are provided to bus 22 from an outside source such as a microprocessor as will be explained in more detail hereinafter in reference with FIG. 3.

Thus during operation, operator circuit 10 may be employed twice to generate a FM signal in accordance with equation 1. The first time that operator circuit 10 is employed the contents of phase buffer 14 is $\omega_m T_n$ for a predetermined number of samples. The contents of envelope generator 12 is the signal B as described in equation (1). Bus 22 includes a feedback disable signal, so that feedback coefficient circuit 20 acts as an open gate. Furthermore, bus 22 does not include a phase signal to be added in adder 18. Thus, phase and envelope information are fed directly to sine signal estimator 16 to generate $$\phi = B \text{ Sin } (\omega_m T_n), \quad (4)$$

in accordance with one embodiment of the invention. The output signal provided by signal estimator 16 is then stored in a temporary buffer so that it can be added to $\omega_c T_n$ in order to generate the signal represented in equation (1).

Thus, the second time operator 10 is employed phase buffer 14 is loaded with data representing $\omega_c T_n$. The contents of the temporary buffer which is represented by equation (4) is provided to adder 18. Envelope generator 12 generates an envelope signal A. Sine signal estimator 16 then estimates the values represented by equation (1) and provides the estimated data to a digital to analog converter so as to be provided to a speaker.

In accordance with another embodiment of the invention operator 10 functions to generate a signal in accordance with equation (2), based on a frequency modulation scheme with feedback. For this embodiment, bus 22 provides an enable signal to feedback circuit 20 with the appropriate value of feedback ratio, β. Thus, the phase of each signal to be processed by estimator 16 is partially derived from the last sample provided by the estimator.

As will be explained in more detail in reference with FIG. 4, operator 10 may be employed many times and in different orders so as to implement various algorithms as desired to produce the sound of musical instruments. The order and the number of times operator 46 can be used may be defined by a predetermined operator usage sequence. Such usage sequence may be stored in processor 42 of synthesizer 40.

Figure 3:
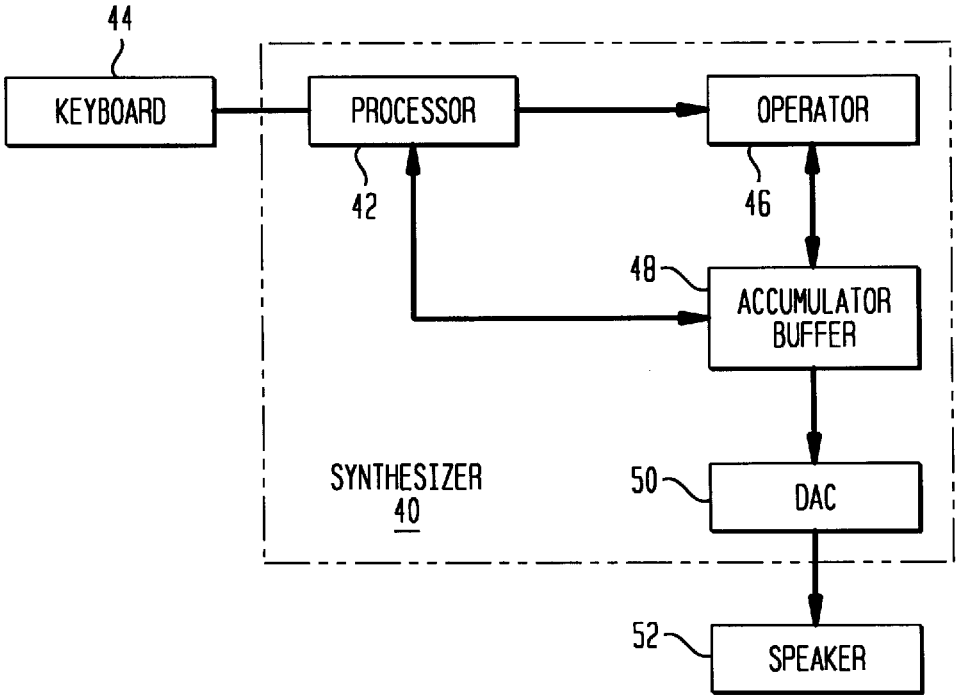
FIG. 3 is a block diagram of a FM synthesizer in accordance with one embodiment of the invention.

FIG. 3 illustrates a synthesizer 40 in accordance with one embodiment of the present invention, although the invention is not limited in scope in that respect. Synthesizer 42 includes a processor 42 which is configured to implement various algorithms to produce a desired sound. For purposes of present discussion the address and data buses that are employed to transfer data between different components of synthesizer 40 have not been shown. However, the flow of signals has been indicated.

Processor 42 is configured to receive a signal from keyboard 44 in accordance with one embodiment of the present invention. Keyboard 44 includes an input interface (not shown), which allows a user to select the desired musical tones.

Synthesizer 40 also includes an operator 46 which is coupled to receive various data and parameters from processor 42. Operator 46 in accordance with one embodiment of the invention is the same as operator 10 described in reference with FIG. 2. An output port of operator 46 is coupled to an input port of an accumulator buffer 48, which acts as a temporary buffer memory that holds the data generated by operator 46, and selectively accumulates the signals generated by operator 46. It is noted that in accordance with one embodiment of the invention, buffer memory 48 may be divided into separate smaller buffer areas each of which configured to store an output of operator 46. Processor 42 retrieves the appropriate data from one of the smaller buffer memories and provides it to operator 46 via a bus as described in reference with the functions of operator 10. Once it is determined that the algorithm employed to produce the desired tone signal does not need to use operator 46, the contents of accumulator buffer 48 are provided to a digital to analog converter 50, which in turn provides the analog signal to speaker 52.

Figure 4:
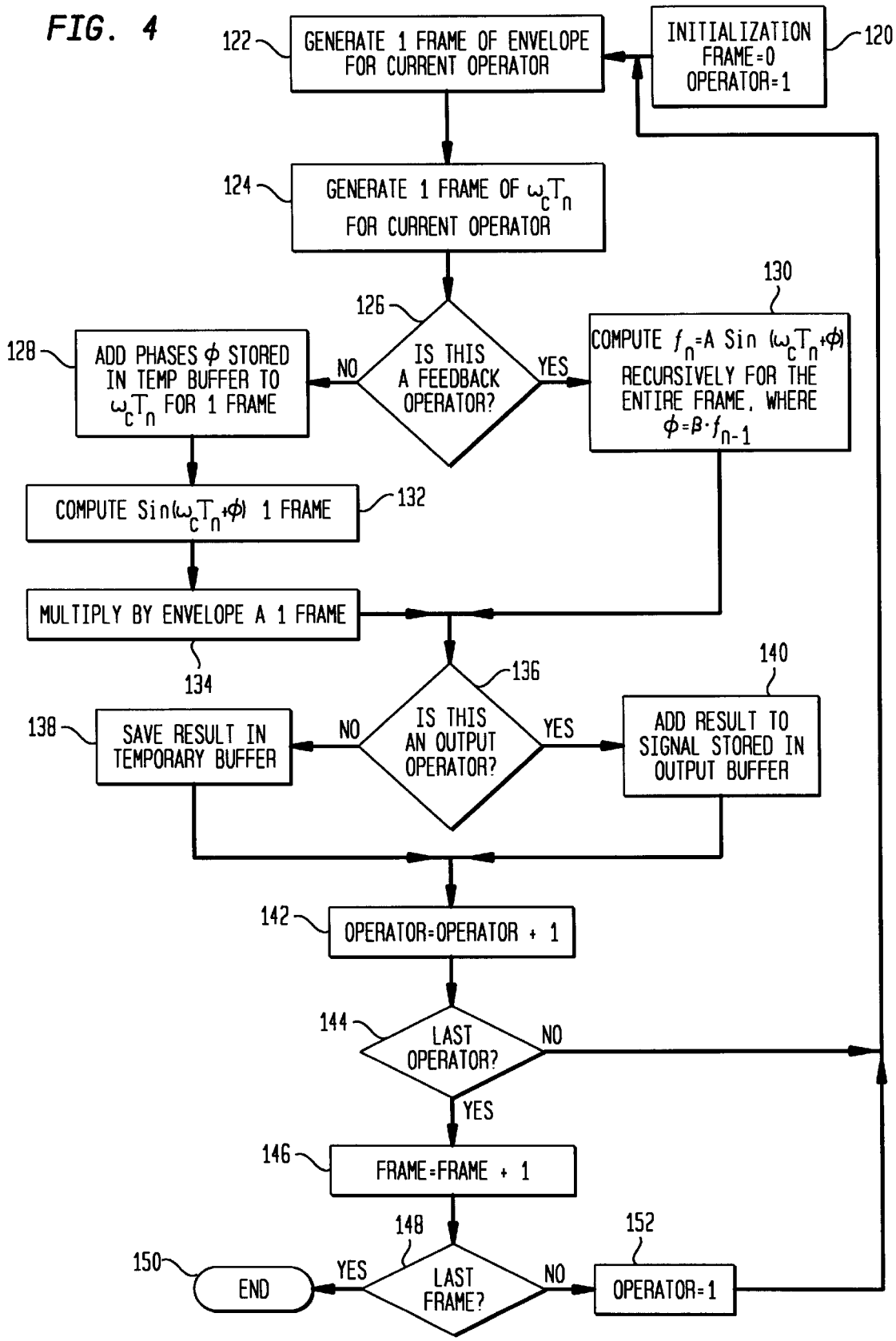
FIG. 4 is a flow chart of the of a method implementing the present invention.

FIG. 4 is a flow chart showing an embodiment of the present invention which may be implemented either in hardware or software on a personal computer. At step 120, variables such as frequency, period, etc., are set to their initial value. Furthermore, operator 46 is assigned to the first use of the operator in a sequence of operator usages. It is noted that the operation usage sequence defines a desired sequence to use operator 46 to generate a desired tone. Some of the uses of the operator relates to instances wherein the operator generates an output signal that needs to be temporarily stored. The temporarily stored output may be used by the operator again in a following use in the usage sequence. Other uses of the operator relate to instances wherein the operator generates an output signal that is intended to drive the output speaker either individually or in conjunction with another output signal devised from another use of the operators. These outputs of the operator are not intended to be used by the operator again and are referred to as output operators.

For software implementation, advantageously, in accordance with one embodiment of the invention, rather than processing the signal samples one by one, synthesizer 40 processes a group of samples, such as 32 samples at a time. Each set of 32 samples is referred to as a frame. It is more efficient to process the signals in a frame format, rather than sample by sample. This follows because every time the operator is used a new set of parameters must be loaded. Then by processing several samples simultaneously there will be considerably less processing associated with switching between the uses of the operators.

It is noted that in one example, each sample is 16 bits wide and each of the 32 samples in a frame relates to the same tone signal. Furthermore, each desired tone defines one channel. For example, when several instruments are being played, each instrument corresponds to one channel. In another example, for a chord on a piano, each note in the chord is assigned to a different channel and each channel is processed separately. The system processes one frame corresponding to each allocated channel and, the sequence is repeated for the next frame corresponding to the allocated channels. All of the sounds are then added together to get the output.

Figure 1C:
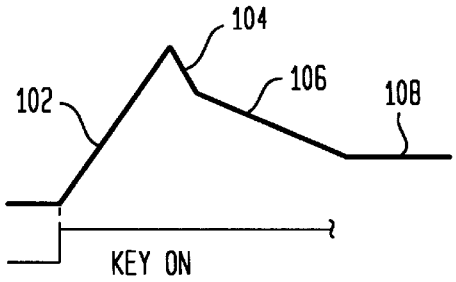
FIG. 1*c* shows an envelope waveform for a percussive sound.
Figure 1D:
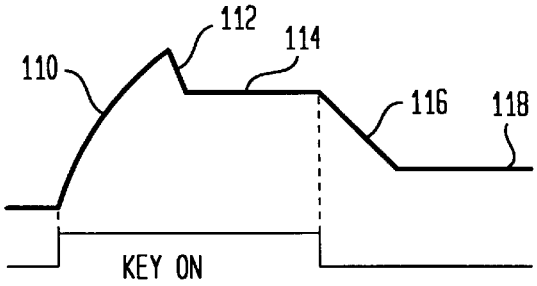
FIG. 1*d* shows an envelope waveform for a non-percussive sound.

Referring now to step 122, an envelope is generated for the current use of the operator. Examples of envelopes are shown in FIGS. 1*c* and 1*d*. For example, when a piano key is pressed, the envelope rises at first and then decays in time. It is noted that this rising and decaying envelope corresponds to parameter "A" of equation (1). It is further noted that the envelope signal corresponding to parameter "B" of equation (1) also has a predetermined shape based on the tone of the waveform to be generated.

Referring to FIGS. 1*c* and 1*d*, the envelope describes how it decays in time. The time of decay depends upon the instrument. If it is a flute or an organ, the envelope decays very slowly. If it is a percussive instrument like a piano, guitar, etc., the shape of the envelope is different than for a non-percussive instrument which decays faster. The envelope is multiplied by the signal generated by the sine estimator to represent how the signal decays in time.

In accordance with one embodiment of the present invention, the signal generated by the envelope generator, such as 12 of FIG. 2 may be derived from a base exponential signal. FIGS. 1*c* and 1*d* illustrate examples of an envelope signal plotted on a logarithmic scale. Illustrated in FIGS. 1*c* and 1*d*, portions 102 through 108 appear linear. All these portions are defined by an exponential function which is scaled in and stretched or compressed in time by interpolation or down-sampling, by retaining smaller sets of available samples. These samples of the exponential function may be stored in envelope generator 12 (FIG. 2). To this end, the corresponding scaling multipliers are provided in the envelope generator. A select subset of the scaling multipliers are then multiplied by the interpolated or down-sampled, exponential to generate the desired envelope.

As mentioned before, synthesizer 40 stores all the appropriate parameters for a desired sound. This includes the scaling multipliers to generate the proper envelope; the feedback factors employed in FM synthesis, the appropriate frequency of the signals and so forth. Thus, when an instrument is changed while playing, the corresponding envelope changes as well in addition to other parameters. It is noted that the information necessary to generate a desired sound may be processed by either a hardware arrangement or a software arrangement. For example for a software implementation, generating each desired tone may be executed by a subroutine that is called by a main software. The parameters necessary to process the subroutine may be stored in some memory space within synthesizer 40.

At step 124 phase buffer 14 of operator 46 receives one frame of phase signals corresponding to $\omega_c T_n$, for a corresponding current usage of operator 46. At step 126 processor 42 determines whether the current use of the operator calls for a feedback arrangement. If not, processor 42 goes to step 128 and retrieves one frame of phase $\phi$ stored in a temporary buffer 48 and adds the retrieved phase $\phi$ samples to $\omega_c T_n$ samples. At step 132 sine estimator 16 computes $\mathrm{Sin}(\omega_c T_n + \phi)$ for one frame in accordance with one embodiment of the invention. At step 134, the signal provided by estimator 16 is multiplied by a corresponding portion of envelope A. Thereafter, processor 42 goes to step 136 to determine whether the current use of operator 46 is as an output operator and as such the operator contributes to the output signal of synthesizer 40.

Processor 42 goes to step 130, if at step 126 it determines that the current operator includes a feedback arrangement. At step 130 the current operator computes $f_n = A\,\mathrm{Sin}(\omega_c T_n + \phi)$, recursively for the entire frame, where $\phi = \beta . f_{n-1}$. Thereafter, processor 42 goes to step 136 to determine whether the current use of operator 46 is an output operator and as such contributes to the output signal of synthesizer 40.

Processor 42 goes to step 138 when it determines that the current usage of operator 46 is not as an output operator. At step 138 the data resulting from sine estimator 16 is stored in a temporary buffer 48. Processor 42, however, goes to step 140 when it determines that the current usage of operator 46 is as an output operator. At step 140 the signal generated by sine estimator 16 is added to an output buffer so as to generate a corresponding sound in speaker 52. It is noted that in accordance with one embodiment of the invention, output buffer may be a portion of buffer memory 48.

Thereafter, processor 42 goes to step 142 to set the parameters that are appropriate for the next entry in the operator usage sequence. At step 144 the processor determines whether the current usage of operator 46 corresponds to the last entry in operator usage sequence. If not, processor 42 goes back to step 122 to repeat the process for the next operator in the sequence. However, if the current usage of operator 46 is the last usage of operator 46 in the operator usage sequence, processor 42 goes to step 146 to process the next signal frame. Thereafter, if at step 148 processor determines that updated frame is the last frame, synthesizer 40 ends its operation to generate a sound.

If at step 148 processor 42 determines that the last frame has not been processed, processor 42 goes to 152 to set the parameters for the first usage of operator 46 in the operator usage sequence. And thereafter, processor 42 goes to step 122 to repeat the steps of generating the desired sound with the next frame.

It is noted that processor 42 processes all the frames corresponding to each channel for all the channels. All the channels are added together to determine the final output for that channel. There can actually be two outputs if the system is stereo. The channels are computed separately and then added together. For a chord of seven notes, each note is going to be assigned as one channel. It could be that some of the channels are not being used at any particular moment.

While only certain features of the invention have been illustrated and described herein, many modifications, substitutions, changes or equivalents will now occur to those skilled in the art. It is therefore to be understood that the appended claims are intended to cover all such modifications and changes that fall within the true spirit of the invention.

We claim:

1. An integrated circuit that includes an operator circuit employed in a FM synthesizer to generate a frequency modulated, FM signal, said operator circuit comprising:

an envelope generator configured to generate a signal corresponding to a desired envelope shape associated with a predetermined sound;

a phase buffer that stores data samples corresponding to a predetermined phase representing the phase of a carrier signal of said FM signal;

a temporary buffer for storing the signals generated by said operator circuit;

an adder coupled to said phase buffer and said temporary buffer for adding the contents of said phase buffer to data stored in said temporary buffer representing the modulating signal of signal of said FM signal; and a sine signal estimator configured to generate a piecewise linear approximation of a desired waveform, said sine signal estimator coupled to said envelope generator and said adder so that the signal provided by said envelope generator defines the amplitude of said desired waveform, and the signal provided by said adder defines the phase of said desired waveform.

2. An operator circuit in accordance with claim 1, further comprising means for providing specified parameters to said envelope generator and said phase buffer for providing said desired waveform.

3. An operator circuit in accordance with claim 2, wherein said sine signal estimator processes a group of data samples defining a frame.

4. An operator circuit in accordance with claim 3, wherein said envelope generator provides amplitude parameters for said frame.

5. An operator circuit in accordance with claim 3, wherein said phase buffer stores phase data corresponding to said frame.

6. An operator circuit in accordance with claim 1, further comprising a feedback circuit coupled to the output port of said sine signal estimator so as to provide a feedback ratio $\beta$ to output signal generated by said operator and provide said feedback signal to said adder.

7. An operator circuit in accordance with claim 6 wherein said operator is employed in accordance with an operator usage sequence.

8. An operator circuit in accordance with claim 7, further comprising a temporary buffer memory configured to save the signal generated by said operator after a usage in said operator usage sequence.

9. An operator circuit in accordance with claim 8 wherein said adder is configured to receive the data stored in said temporary buffer memory.

10. A method for generating a desired FM signal by employing an FM synthesizer comprising the steps of:

generating an envelope signal corresponding to a desired envelope shape associated with a predetermined sound;

storing in a phase buffer data samples corresponding to a predetermined phase representing the phase of a carrier signal of said FM signal;

adding the contents of said phase buffer to phase data stored in a temporary buffer representing the modulating signal of said FM signal; and generating a piecewise linear approximation of a desired waveform, such that said envelope signal defines the amplitude of said desired waveform, and said modulating signal defines the phase of said desired waveform.

11. The method in accordance with claim 10, further comprising the step of providing specified parameters to said envelope generator and said phase buffer for generating aid desired waveform.

12. The method in accordance with claim 11, wherein said step of generating a linear approximation of a waveform comprises approximation of a group of data samples defining a frame.

13. The method in accordance with claim 12, wherein said step of generating an envelope signal further comprises the step of providing amplitude parameters for said frame.

14. The method in accordance with claim 12, further comprising the step of storing phase data corresponding to said frame.

15. The method in accordance with claim 10, further comprising the step of generating a feedback signal representing a phase component of said modulating frequency.

16. The method in accordance with claim 15, further comprising the step of generating said piecewise linear approximation in accordance with an operator usage sequence.

17. The method in accordance with claim 16, further comprising the step of saving the signal generated by said step of piecewise linear approximation step after each usage in said operator usage sequence.

18. The method in accordance with claim 17 further comprising the step of adding said data stored in said temporary buffer memory.

19. A method for generating a waveform for use in FM synthesis, comprising the following steps:

(a) identifying a desired waveform to be generated for use;

(b) creating a piecewise linear approximation of the desired waveform;

(c) storing the coefficients of the piecewise linear approximation in a memory device; and (d) retrieving said coefficients upon demand for use in generating a waveform for use in FM synthesis.

20. An integrated circuit that includes a signal estimator to generate a desired waveform, as a function of a variable, said signal estimator comprising:

a memory device configured to store a plurality of coefficients representing a plurality of lines, wherein each line corresponds to a predetermined segment that represents a set of said variable; and waveform generating means coupled to said memory device configured to retrieve at least one of said coefficients so as to generate a linear approximated value for said desired waveform corresponding to one of said variables.

21. The signal stimulator in accordance with claim 20 wherein said waveform is a sine wave.

22. The signal estimator in accordance with claim 22 further comprising an envelope generator coupled to said waveform generating means configured to generate a signal corresponding to a desired envelope shape associated with said desired waveform.

23. The signal estimator, accordance with claim 22 wherein said signal estimator processes a group of data samples defining a frame.

24. The signal estimator, in accordance with claim 23, wherein said envelope generator provides amplitude parameters for said frame.

* * * * *